US008371029B2

(12) United States Patent
Ito et al.

(10) Patent No.: US 8,371,029 B2
(45) Date of Patent: Feb. 12, 2013

(54) PRODUCTION APPARATUS AND PRODUCTION METHOD FOR CRANKSHAFT

(75) Inventors: Yasuhiro Ito, Tochigi (JP); Takayuki Ohnuma, Tochigi (JP); Tsutomu Ando, Tochigi (JP); Yasuyuki Kondo, Tsuzuki-gun (JP)

(73) Assignees: Honda Motor Co., Ltd., Tokyo (JP); Nichidai Corporation, Kyoto (JP)

( * ) Notice: Subject to any disclaimer, the term of this patent is extended or adjusted under 35 U.S.C. 154(b) by 268 days.

(21) Appl. No.: 12/731,937

(22) Filed: Mar. 25, 2010

(65) Prior Publication Data

US 2010/0242241 A1 Sep. 30, 2010

(30) Foreign Application Priority Data

Mar. 27, 2009 (JP) ..... 2009-080057

(51) Int. Cl.
*B21K 1/08* (2006.01)
*B21J 5/06* (2006.01)

(52) U.S. Cl. ..... 29/888.08; 29/6.01; 29/888.1; 29/428; 72/353.2; 72/356; 72/372

(58) Field of Classification Search ..... 29/6.01, 29/428, 468, 888, 888.08, 888.1; 72/80, 72/110, 353.2, 356, 357, 372, 412
See application file for complete search history.

(56) References Cited

U.S. PATENT DOCUMENTS 3,313,016 A * 4/1967 Seulen et al. ..... 29/898.1
3,750,450 A * 8/1973 Sharp et al. ..... 72/353.2
4,297,869 A * 11/1981 Oldford ..... 72/405.11
4,516,299 A * 5/1985 Martin ..... 29/888.08
5,163,341 A * 11/1992 Murrish et al. ..... 74/595
2005/0011925 A1* 1/2005 Momose et al. ..... 225/1
2005/0044706 A1* 3/2005 Momose ..... 29/888.09
2005/0284311 A1* 12/2005 Politino et al. ..... 99/547
2010/0107808 A1* 5/2010 Alderton et al. ..... 74/605
2010/0242241 A1* 9/2010 Ito et al. ..... 29/6.01
2011/0085865 A1* 4/2011 Yoshimoto ..... 408/1 R
2011/0308052 A1* 12/2011 Ohnuma et al. ..... 29/6.01
2012/0024105 A1* 2/2012 Ohnuma et al. ..... 74/605

FOREIGN PATENT DOCUMENTS

CN 1974199 A 6/2007
JP 61-143727 U 9/1986
JP 01-104436 A 4/1989

(Continued)

OTHER PUBLICATIONS

Japanese Office Action dated Nov. 22, 2012.

*Primary Examiner* — Livius R Cazan
*Assistant Examiner* — Kaying Kue
(74) *Attorney, Agent, or Firm* — Arent Fox LLP

(57) ABSTRACT

The present invention provides a production apparatus for crankshaft, including: a die which has a lower die, an upper die, and plural side forming punches, the upper die being provided movably to the lower die, the side forming punches moving perpendicularly to a movement direction of the upper die; a press ram which moves the upper die to the lower die, closes a material of the crankshaft, and forms the material; cam mechanisms which are provided for the side forming punches and which move the side forming punches to an inside portion of the die in accordance with movement of the press ram; a grade separation structure which is provided to at least one of the side forming punches in order to prevent interference of the side forming punches with each other.

3 Claims, 4 Drawing Sheets

FOREIGN PATENT DOCUMENTS

| | | | | |
|---|---|---|---|---|
| JP | 03-243232 | A | | 10/1991 |
| JP | 2000291624 | A | * | 10/2000 |
| JP | 2003-326332 | A | | 11/2003 |
| JP | 2003-343592 | A | | 12/2003 |

* cited by examiner

PRODUCTION APPARATUS AND PRODUCTION METHOD FOR CRANKSHAFT

BACKGROUND OF THE INVENTION

1. Field of the Invention

The present invention relates to a production apparatus and a production method for crankshafts. In particular, it relates to an improvement in a technique for forming of plural hollow hole portions to a crankshaft for weight reduction thereof.

2. Description of Related Art

A crankshaft of internal-combustion engine has a journal shaft portion. A crankpin portion parallel to the journal shaft portion is connected to the journal shaft portion by arm portions. A counterweight portion is formed to the arm portion. In the arm portion, the formed position of the counterweight portion with respect to the journal shaft portion is opposite to the connected position of the crankpin portion. In the crankshaft, in order to improve fuel consumption, a hollow hole portion may be formed to the crankpin portion for weight reduction thereof. Even when the hole portion is formed to the crankpin portion, the influence on the stiffness of the crankshaft is small, so that it is desirable to form the hole portion to the crankpin portion.

In formation of a hole portion to a crankpin portion, a forging apparatus may be used. The forging apparatus has a side forming punch which moves in a direction perpendicular to a movement direction of a press ram. A cam mechanism has been used as a driving source for the side forming punch of the forging apparatus as disclosed in Japanese Unexamined Patent Application Publication Nos. H1-104436 and 2003-343592. The cam mechanism has a mechanism which is simpler than that of servomotors and hydraulic apparatus, the cam mechanism is not provided outside a die set, and the cam mechanism allows the side forming punch to linearly follow the action of the press ram.

FIG. 7 is a conceptual diagram for explanation of action of a side forming punch 20 (hereinafter referred to as "punch 20") by a cam mechanism 10. The cam mechanism 10 is equipped with a cam 11, a cam driver 12, and a cam holder 13. The cam driver 12 drives the cam 11. The cam 11 and the cam driver 12 are slidably supported by the cam holder 13. The punch 20 is provided at a side surface of the cam 11 which faces an inside of a die, and a side surface of the cam 11 which faces an outside of a die is an inclined surface. A lower surface of the cam driver 12 is an inclined surface. In an initial condition, the lower surface of the cam driver 12 is positioned so as to be spaced a predetermined distance from the inclined surface of the cam 11. In action of the cam 11, the lower surface of the cam driver 12 slides on the inclined surface of the cam 11. In the cam mechanism 10, when an upper plate 31 moves a predetermined distance downwardly to a lower plate 32 by a press ram (not shown in the Figure), the inclined surfaces of the cam 11 and the cam driver 12 contact each other. When the upper plate 31 moves further downwardly, the inclined surfaces of the cam 11 and the cam driver 12 slide on each other, and the punch 20 moves toward the inside of the die in a horizontal direction.

However, when a crankshaft is formed by the above forging apparatus, it is necessary that the punch 20 be inserted into the crankpin portion from an axial direction of the crankshaft since the crankshaft is disposed in the die such that the axial direction of the crankshaft should be perpendicular to a movement direction of the press ram. Due to this, when a hole portion is formed to each crankpin portion of the crankshaft having plural cylinders, punches collide with each other.

Specifically, in side forming which uses the cam mechanism 10, the cam 11 acts in accordance with the movement of the press ram, so that the inserted length of the punch 20 provided on the cam 11 is maximum when the press ram arrives at a bottom dead point. Next, when the press ram moves to a top dead point, the punch 20 is removed from the crankpin portion. Due to this, for example, as shown in FIG. 8, when a hole portion 44 is formed to each crankpin portion of crankshaft 40 which is used for four cylinders and has a full counterweight structure, punches 21 and 22 collide with each other, and punches 23 and 24 collide with each other (as shown in a portion surrounded by a dotted line in FIG. 8). As a result, during one stroke of the press ram from the top dead point to the bottom dead point, plural hole portions, which are positioned such that the punches for forming of them interfere with each other, cannot be formed. Reference numerals 41 and 42 denote a journal shaft portion and a crank arm portion.

SUMMARY OF THE INVENTION

An object of the present invention is to provide a production apparatus and a production method for crankshafts, which can perform formation of plural hole portions during one stroke of a press ram from a top dead point to a bottom dead point even when a cam mechanism is used as a driving source for side forming punches and the hole portions are positioned such that the punches interfere with each other.

According to one aspect of the present invention, a production apparatus for crankshaft includes: a die which has a lower die, an upper die, and plural side forming punches, the upper die being provided movably to the lower die, the side forming punches moving perpendicularly to a movement direction of the upper die; a press ram which moves the upper die to the lower die, closes a material of the crankshaft, and forms the material; cam mechanisms which are provided for the side forming punches and which move the side forming punches to an inside portion of the die in accordance with movement of the press ram; a grade separation structure which is provided to at least one of the side forming punches in order to prevent interference of the side forming punches with each other.

In the production apparatus of the one aspect of the present invention, the material of the crankshaft is closed and formed into a predetermined shape in the die by the movement of the press ram, and the cam mechanisms also move the side forming punches (hereinafter referred to as "punches") to the inside portion of the die in accordance with the movement of the press ram, so that hole portions are formed to predetermined portions of the material by the punches. Since the grade separation structure is provided to at least one of the side forming punches in order to prevent the interference of the side forming punches with each other, the punches can cross each other in a grade separation manner when they move to and retreat from the inside portion of the die. Therefore, the formation of the hole portions can be simultaneously performed on the material of the crankshaft. Thus, the formation of the plural hole portions can be performed in one stroke of the press ram from a top dead point to a bottom dead point.

As described above, since the cam mechanisms, which can be provided in a die set, can be used as a driving source for the punches, it is unnecessary to use a space at which external devices (for example, actuators) independently controlling the punches are disposed, so that a press apparatus can be compact, and workability and productivity can be improved. Since the grade separation structure, which is formed to at least one of the punches, is simple structures, the press apparatus can be more compact. Since the movement ranges of the punches can be set within the space of the dieset, safety of operators can be secured.

The production apparatus for crankshaft can use various structures. According to one preferred embodiment of the present invention, the grade separation structure may be a through-hole portion formed to one of the side forming punches, and another of the side forming punches may move in the through-hole portion during forming of hole portions of the crankshaft.

According to another aspect of the present invention, a production method for crankshaft includes the above side forming method of the plural hole portions by the production apparatus for crankshaft. That is, a production method for crankshaft uses: a die which has a lower die, an upper die, and plural side forming punches, the upper die being provided movably to the lower die, the side forming punches moving perpendicularly to a movement direction of the upper die. The production method includes: a preparing step of a material of the crankshaft; and a forming step that a press ram moves the upper die to the lower die so that the material of the crankshaft is closed and formed in the die, and cam mechanisms also move the side forming punches to an inside portion of the die in accordance with a movement of the press ram in forming of the material, so that hole portions are formed to predetermined portions of the material by the side forming punches, wherein when the material has a shape such that the side forming punches may interfere with each other in forming of the hole portions to the material by the side forming punches, the side forming punches cross each other in a grade separation manner.

In the production method of the another aspect of the present invention, the same effects as those by the production apparatus using the grade separation structure can be obtained.

According to the production apparatus or the production method for crankshaft of the present invention, when the material has a shape such that the side forming punches may interfere with each other in forming of the hole portions to the material by the side forming punches, the formation of the hole portions can be simultaneously performed on the material of the crankshaft, so that the formation of the plural hole portions can be performed in one stroke of the press ram from the top dead point to the bottom dead point. As a result, the press apparatus can be compact and another effect can be obtained.

BRIEF DESCRIPTION OF THE DRAWINGS

FIG. 1 is a perspective view which shows a die.

FIG. 2 is a schematic cross sectional view taken at line of A-A' shown in FIG. 1.

FIG. 4A shows a condition of the side forming punches before grade separation, and FIG. 4B shows a condition of the side forming punches in grade separation.

DESCRIPTION OF THE PREFERRED EMBODIMENTS

1. Construction of Embodiment

Figure 1:
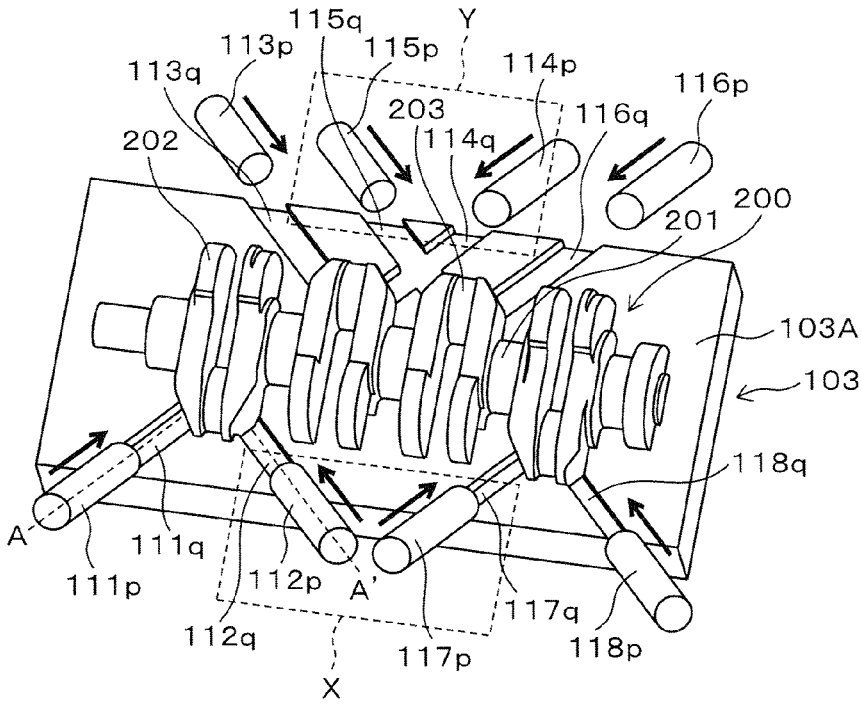
FIG. 1 is a conceptual diagram which shows a construction of a portion of a production apparatus for crankshafts of one embodiment according to the present invention.
Figure 2:
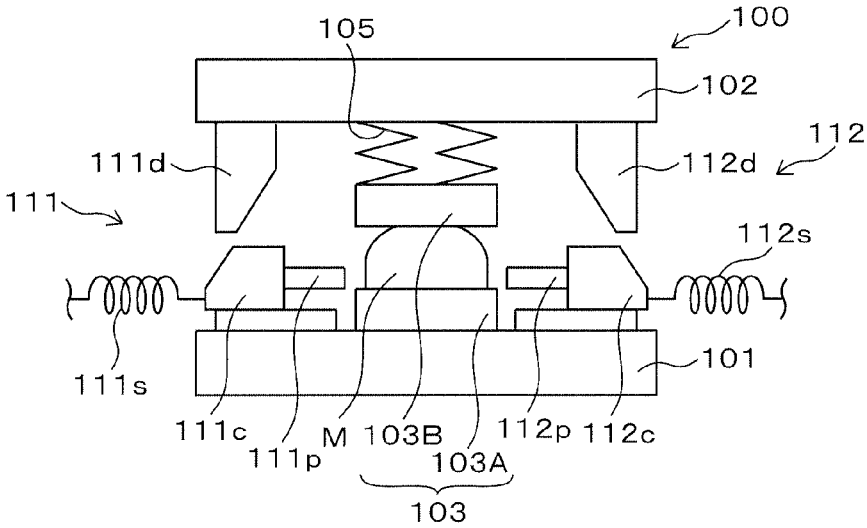
FIG. 2 is a conceptual diagram which schematically shows a construction of the production apparatus for crankshafts of one embodiment according to the present invention.
Figure 3:
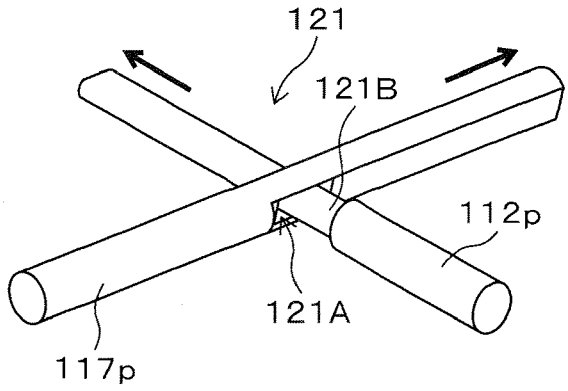
FIG. 3 is a perspective view which schematically shows structures of side forming punches shown in FIG. 1.
Figure 4A:
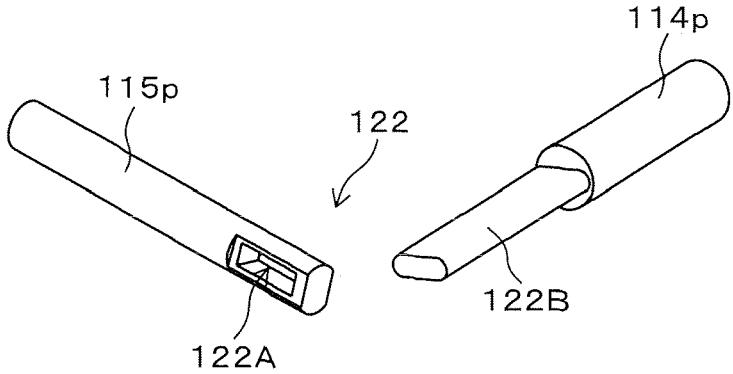
FIGS. 4A and 4B are perspective views which schematically show structures of side forming punches shown in FIG. 1.
Figure 4B:
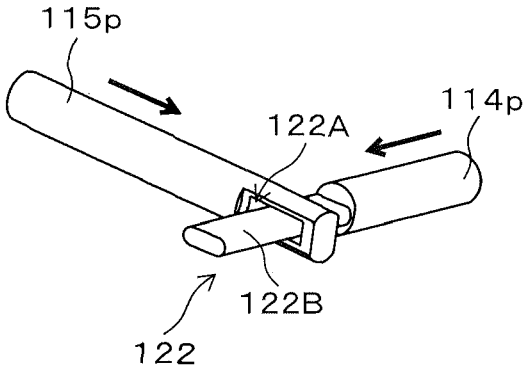

One embodiment of the present invention will be described hereinafter with reference to Figures. FIG. 1 is a conceptual diagram which shows a construction of a portion of a crankshaft production apparatus 100 of one embodiment according to the present invention, and FIG. 1 is a perspective view which shows a lower die 103A of a die 103. FIG. 2 is a conceptual diagram which schematically for action explanation of the crankshaft production apparatus 100 of one embodiment according to the present invention, and FIG. 2 is a cross sectional view taken at line of A-A' shown in FIG. 1. FIG. 3 is a perspective view which schematically shows structures of side forming punches 112*p* and 117*p* shown in FIG. 1. FIGS. 4A and 4B are perspective views which schematically show structures of side forming punches 114*p* and 115*p* shown in FIG. 1, and FIG. 4A shows a condition of the side forming punches 114*p* and 115*p* before grade separation and FIG. 4B shows a condition of the side forming punches 114*p* and 115*p* in grade separation. In FIG. 1, cam mechanisms are not shown for illustration convenience.

For example, the crankshaft production apparatus 100 is used for formation of hole portions to a crankshaft which is used for four cylinders and has a full counterweight structure. For example, the crankshaft production apparatus 100 is equipped with a press bolster 101, and a press ram 102 is supported on the press bolster 101. A die 103 is disposed between the press bolster 101 and the press ram 102. The die 103 is equipped with a lower die 103A, an upper die 103B, and side forming punches 111P to 118*p* (hereinafter referred to as "punches 111P to 118*p*"). A preform 200 is disposed in the die 103.

The preform 200 has a journal shaft portion 201, and arm portions 202 are provided to the journal shaft portion 201. The arm portions 202 proximate to each other are connected by crankpin portions 203. The crankpin portions 203 are parallel to the journal shaft portion 201. The die 103 has a cavity surface having a shape corresponding to the preform 200. The upper die 103B is provided so as to be movable to the lower die 103A. Reference numeral 105 in FIG. 2 denotes a load adjustment device (hydraulic apparatus, air pressure device, or the like).

The punches 111P to 118*p* are provided so as to be movable perpendicularly to a movement direction of the upper die 103B. The punches 111P to 118*p* are insertable into an inside portion of the die 103 via punch passages 111*q* to 118*q* which are formed at side portions of the die 103. The punches 111P to 118*p* have cam mechanisms which move the punches 111P to 118*p* to the inside portion of the die 103 in accordance with movement of the press ram 102.

As shown in FIG. 2, cam mechanisms 111 and 112, which move the punches 111P and 112*p*, are equipped with cams 111*c* and 112*c* and cam drivers 111*d* and 112*d* which drive the cams 111*c* and 112*c*. Cam mechanisms, which move the punches 1113 and 118*p*, have the almost same structures and actions as those of the punches 111P and 112*p*, and explanation for the cam mechanisms of the punches 1113 and 118*p* is thereby omitted.

The punches 111*p* and 112*p* are provided at side surfaces of the cam 111*c* and 112*c* which face the inside of the die 103, and side surfaces of the cams 111*c* and 112*c* which face an outside of the die 103 are inclined surfaces. Lower surfaces of the cam drivers 111*d* and 112*d* are inclined surfaces. In an initial condition, the lower surfaces of the cam drivers 111*d* and 112*d* are positioned so as to be spaced a predetermined distance from the inclined surfaces of the cams 111*c* and 112*c*. The cam drivers 111*d* and 112*d* move downwardly in accordance with the downward movement of the press ram 102. The lower surfaces (inclined surfaces) of the cam drivers 111*d* and 112*d* contact the inclined surfaces of the cams 111*c* and 112*c*, and these inclined surfaces slide on each other.

Retreat members 111*s* and 112*s* are provided to the cam mechanisms 111 and 112. After side forming by the punches 111*p* and 112*p* at a bottom dead point of the press ram 102, when the cam drivers 111*d* and 112*d* move upwardly in accordance with the movement of the press ram 102 to a top dead point thereof, the punches 111*p* and 112*p* are retreated to the outside of the die 103 by the retreat members 111*s* and 112*s*, and return to initial positions thereof.

In order not to interfere the punches 112*p* and 117*p* with each other at a region X shown in FIG. 1 and not to interfere the punches 114*p* and 115*p* with each other at a region Y shown in FIG. 1, a grade separation structure 121 is provided to the punches 112*p* and 117*p*, and a grade separation structure 122 is provided to the punches 114*p* and 115*p*.

Specifically, at the interference region X for the punches 112*p* and 117*p*, the arm portions 202 of the preform 200, into which the punches 111*p* and 117*p* are inserted, are away from each other, so that the grade separation structure 121 are provided so as to be away from the cavity of the die 103. The grade separation structure 121 has a through hole portion 121A and a flat portion 121B. The through hole portion 121A is formed to the punch 117*p*, and the flat portion 121B is formed to the punch 112*p*. In the grade separation structure 121, the flat portion 121B is movably disposed in the through hole portion 121A, and the punches 112*p* and 117*p* can cross each other in a grade separation manner. In this case, each axial direction length of the through hole portion 121A and the flat portion 121B is designed such that the punches 112*p* and 117*p* do not interfere with each other when the punches 112*p* and 117*p* move to and retreat from the die 103.

At the interference region Y for the punches 114*p* and 115*p*, the arm portions 202 of the preform 200, into which the punches 114*p* and 115*p* are inserted, are proximate to each other, so that the grade separation structure 122 are provided so as to be proximate to the cavity of the die 103. The grade separation structure 122 has a through hole portion 122A and a flat portion 122B. The through hole portion 122A is formed to the punch 115*p*, and the flat portion 122B is formed to the punch 114*p*. In the grade separation structure 122, the flat portion 122B is movably disposed in the through hole portion 122A, and the punches 114*p* and 115*p* can cross each other in a grade separation manner when the punches 112*p* and 117*p* are inserted into the crankpin portions 203. In this case, each axial direction length of the through hole portion 122A and the flat portion 122B is designed such that the punches 114*p* and 115*p* do not interfere with each other when the punches 114*p* and 115*p* move to and retreats from the die 103.

Figure 5A:
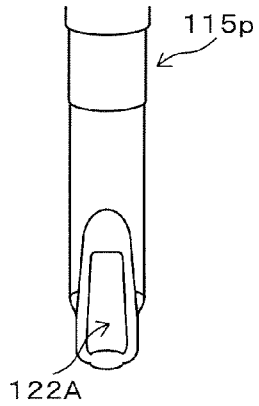
FIGS. 5A and 5B are side views which show examples of the side forming punches shown in FIGS. 4A and 4B.
Figure 5B:
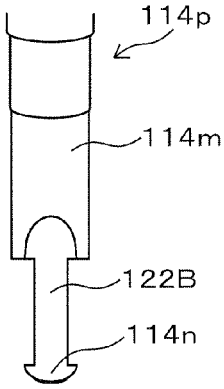

FIGS. 5A and 5B are side views which show examples of the punches 114*p* and 115*p* provided at a portion proximate to the cavity. In the punch 114*p*, the flat portion 122B is formed between a main body portion 114*m* and a leading end portion 114*n*. The leading end portion 114*n* performs side forming, and the leading end portion 114*n* has a width wider than that of the flat portion 122B. The flat portion 122B has a shape so as to be movable in the through-hole portion 122A of the punch 115*p*.

Figure 6:
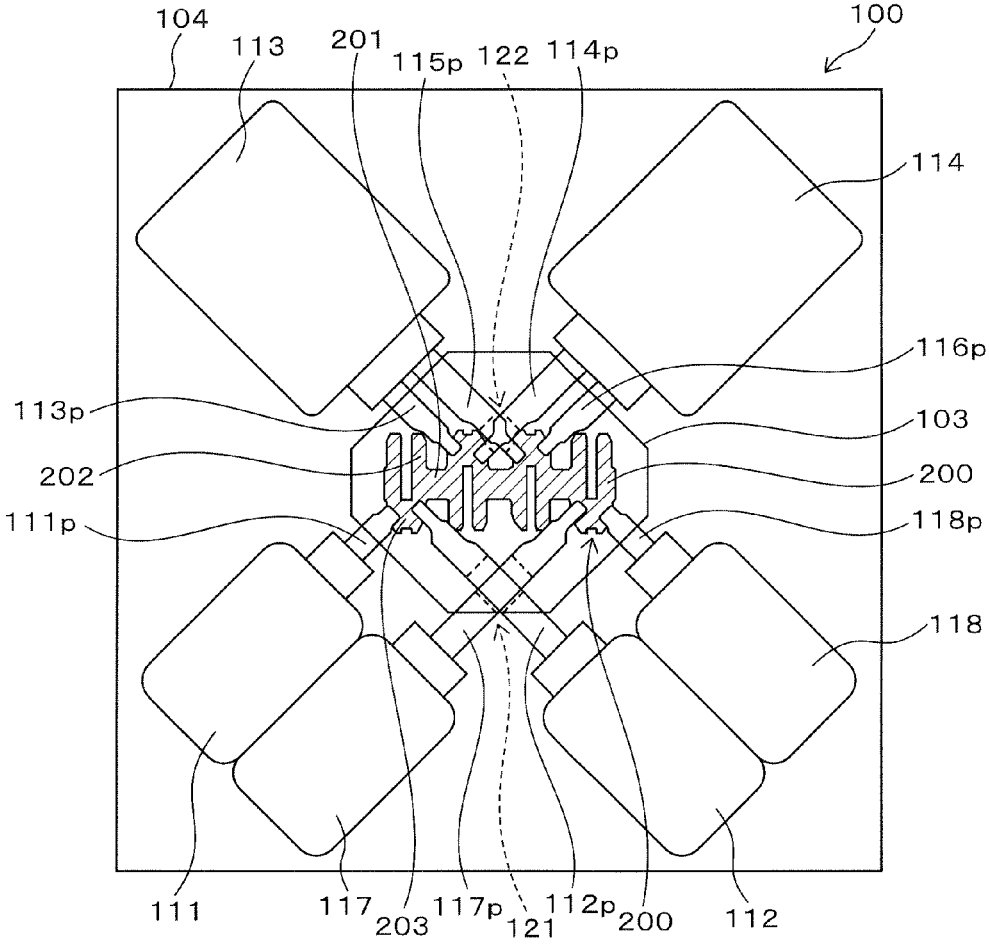
FIG. 6 is a schematic top view which shows one layout example of the production apparatus for crankshafts of one embodiment according to the present invention.
Figure 7:
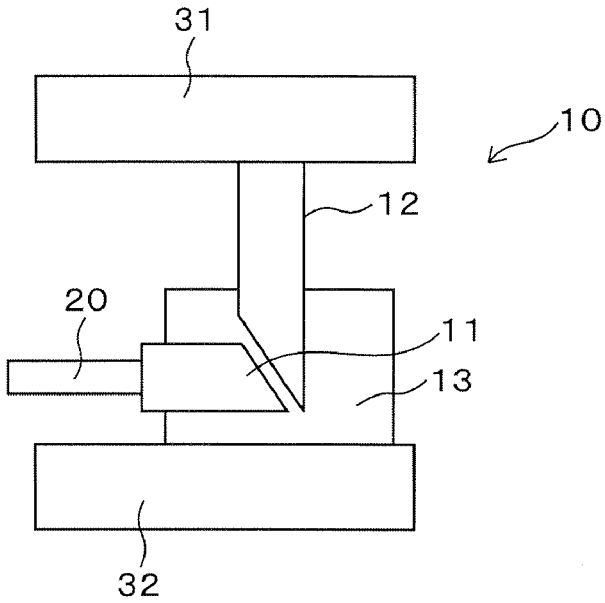
FIG. 7 is a side cross sectional view which schematically shows a cam mechanism of conventional production apparatus for crankshafts.
Figure 8:
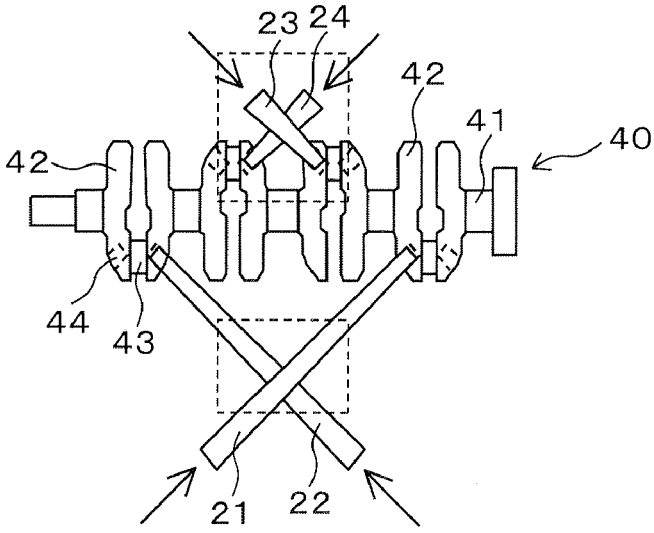
FIG. 8 is a schematic top view for explanation of problems of conventional production apparatus for crankshafts.

FIG. 6 is a schematic top view which shows one layout example of the crankshaft production apparatus 100. In the example, reference numeral 113 denotes a cam mechanism which moves the punches 113*p* and 115*p*. Reference numeral 114 denotes a cam mechanism which moves the punches 114*p* and 116*p*. Reference numerals 117 and 118 denote cam mechanisms which move the punches 117*p* and 118*p*. Reference numeral 104 denotes a surface of bed on which the press bolster 101 is mounted. Another components are the same components as those shown by reference numerals in FIGS. 1 to 4. In the example shown in FIG. 6, in the above manner, the one cam mechanism 113 is used for the movements of the two punches 113*p* and 115*p*, and the one cam mechanism 114 is used for the movements of the two punches 114*p* and 116*p*. Alternatively, one cam mechanism may be used for each movement of the punches 113*p* to 116*p* in the same manner as for the other punches.

2. Action of Embodiment

The action of the crankshaft production apparatus 100 will be explained hereinafter with main reference to FIGS. 2 to 4. Since actions of the punches 113*p* to 118*p* by the cam mechanisms are almost the same as those of the punches 111*p* and 112*p* using the cam mechanisms 111 and 112, in the following explanation, the actions of the punches 111*p* and 112*p* are mainly used.

First, in the cavity of the die 103, the preform 200 of the crankshaft is disposed. Next, when the press ram 102 starts moving downwardly from the top dead point, the cam drivers (in the cam mechanisms 111 and 112, reference numerals 111*d* and 112*d* in FIG. 2) moves downwardly in accordance with the downward movement of the press ram 102, and the inclined surfaces of the cam drivers contact the inclined surfaces of the cams (in the cam mechanisms 111 and 112, reference numerals 111*c* and 112*c* in FIG. 2). When the press ram 102 moves further downwardly, the above inclined surfaces slide on each other, and the punches 111*p* and 112*p* move to the inside of the die 103 in a horizontal direction. Then, hole portions are formed to the crankpin portions 203 of the preform 200 by the punches 111*p* to 118*p*.

Next, when the press ram 102 arrives at the bottom dead point, stroke length of the cams are maximum, and side forming by the punches 111*p* to 118*p* are completed. Next, when the cam drivers start moving upwardly in accordance with the upward movement of the press ram 102 to the top dead point, the cams are retreated to the outside of the die 103 by the retreat members (in the cam mechanisms 111 and 112, reference numerals 111*s* and 112*s* in FIG. 2). After the cams return to initial positions thereof, a release pin of the die is acted, so that a crankshaft having the hole portions formed thereat is removed from the die.

In the formation of the hole portions to the preform 200 described above, the punches 112*p* and 117*p* and the punches 114*p* and 115*p* having the regions X and Y at which they may interfere with each other in the conventional technique, they can cross each other in a grade separation manner by the grade separation structures 121 and 122.

Specifically, in the grade separation structure 121, as shown in FIG. 3, the flat portion 121B can move in the through hole portion 121A, and the punches 112*p* and 117*p* can cross each other in a grade separation manner. In the grade separation structure 122, the flat portion 122B of the punch 114*p* shown in FIG. 4A is inserted into the through hole portion 122A of the punch 115*p*, and the punches 114*p* and 115*p* can cross each other in a grade separation manner.

In the above manner, the punches 112*p* and 117*p* can cross each other in a grade separation manner and the punches 114*p* and 115*p* can cross each other in a grade separation manner when they move to and retreat from the inside portion of the die 103. Therefore, the formation of the hole portions can be simultaneously performed on the preform 200 of the crankshaft. Thus, the formation of the plural hole portions can be performed in one stroke of the press ram 102 from the top dead point to the bottom dead point. The cam mechanisms, which can be provided in a die set, can be used as a driving source for the punches 111*p* to 118*p*, it is unnecessary to use a space at which external devices (for example, actuators) independently controlling the punches 111*p* to 118*p* are disposed, so that a press apparatus can be compact, and workability and productivity can be improved. Since the grade separation structures, which are formed to the punches, are simple structures, the press apparatus can be more compact. Since the movement ranges of the punches 111*p* to 118*p* can be set within the space of the dieset, safety of operators can be secured.

What is claimed is:

1. A production apparatus for crankshaft, comprising:

a die which has a lower die, an upper die, and plural side forming punches, the upper die being provided movably to the lower die, the side forming punches moving perpendicularly to a movement direction of the upper die;

a press ram which moves the upper die to the lower die, closes a material of the crankshaft, and forms the material;

cam mechanisms which are provided for the side forming punches and which move the side forming punches to an inside portion of the die in accordance with movement of the press ram;

a grade separation structure which is provided to at least one of the side forming punches in order to prevent interference of the side forming punches with each other.

2. A production apparatus for crankshaft according to claim 1, wherein the grade separation structure is a through-hole portion formed to one of the side forming punches, and another of the side forming punches moves in the through-hole portion during forming of hole portions of the crankshaft.

3. A production method for crankshaft, using:

a die which has a lower die, an upper die, and plural side forming punches, the upper die being provided movably to the lower die, the side forming punches moving perpendicularly to a movement direction of the upper die, the production method including:

a preparing step of a material of the crankshaft; and a forming step that a press ram moves the upper die to the lower die so that the material of the crankshaft is closed and formed in the die, and cam mechanisms also move the side forming punches to an inside portion of the die in accordance with a movement of the press ram in forming of the material, so that hole portions are formed to predetermined portions of the material by the side forming punches, wherein when the material has a shape such that the side forming punches may interfere with each other in forming of the hole portions to the material by the side forming punches, the side forming punches cross each other in a grade separation manner.

* * * * *